US005759640A

United States Patent [19]

Mannava et al.

[11] Patent Number: 5,759,640

[45] Date of Patent: Jun. 2, 1998

[54] METHOD FOR FORMING A THERMAL BARRIER COATING SYSTEM HAVING ENHANCED SPALLATION RESISTANCE

[75] Inventors: Seetharamaiah Mannava, Cincinnati; Antonio F. Maricocchi, Loveland; Andi K. Bartz, Middletown, all of Ohio

[73] Assignee: General Electric Company, Cincinnati, Ohio

[21] Appl. No.: 777,181

[22] Filed: Dec. 27, 1996

[51] Int. Cl.[6] ..... B05D 3/00

[52] U.S. Cl. ..... 427/554; 427/558; 427/559

[58] Field of Search ..... 427/554, 558, 427/559; 148/224, 565, 525

[56] References Cited

U.S. PATENT DOCUMENTS

| | | | |
|---|---|---|---|
| 4,532,191 | 7/1985 | Humphries et al. | 428/678 |
| 5,015,502 | 5/1991 | Strangman et al. | 427/248.1 |
| 5,419,971 | 5/1995 | Skelly et al. | 428/612 |
| 5,514,482 | 5/1996 | Strangman | 427/554 |

OTHER PUBLICATIONS

K. Matsumura, "Laser-enhanced Plasma Anodization", J. Appl. Phys. (1989), 66(3), pp. 1103–1106.

*Primary Examiner*—Katherine A. Bareford

*Attorney, Agent, or Firm*—Andrew C. Hess; Nathan D. Herkamp

[57] ABSTRACT

A method of forming a thermal barrier coating on an article designed for use in a hostile thermal environment, such as turbine, combustor and augmentor components of a gas turbine engine. The method is particularly directed to increasing spallation resistance of thermal barrier coatings composed of an aluminum-containing bond coat formed on the surface of an article, and an insulating ceramic layer overlaying the bond coat. Processing steps include forming the bond coat on the surface of the article, and then treating the surface of the bond coat with laser energy so as to form a diffusion barrier layer of alumina. Thereafter, a ceramic material is deposited on the surface of the diffusion barrier layer so as to form the insulating ceramic layer. A preferred technique for the treating step is to scan the surface of the bond coat with an ultraviolet laser beam characterized by an appropriate beam geometry and fluence to yield the desired diffusion barrier layer.

17 Claims, 2 Drawing Sheets

METHOD FOR FORMING A THERMAL BARRIER COATING SYSTEM HAVING ENHANCED SPALLATION RESISTANCE

This invention was made with Government support under Agreement No. N00019-92-C-0149 awarded by the United States Navy. The Government has certain rights in the invention.

This invention relates to thermal barrier coating systems for components exposed to high temperatures, such as the hostile thermal environment of a gas turbine engine. More particularly, this invention is directed to a process for forming a thermal barrier coating system, in which the resulting coating system exhibits enhanced resistance to spallation.

BACKGROUND OF THE INVENTION

Higher operating temperatures of gas turbine engines are continuously sought in order to increase their efficiency. However, as operating temperatures increase, the high temperature durability of the components of the engine must correspondingly increase. Significant advances in high temperature capabilities have been achieved through formulation of nickel and cobalt-base superalloys, though such alloys alone are often inadequate to form components located in certain sections of a gas turbine engine, such as the turbine, combustor and augmentor. A common solution is to thermally insulate such components in order to minimize their service temperatures. For this purpose, thermal barrier coating (TBC) formed on the exposed surfaces of high temperature components have found wide use.

To be effective, thermal barrier coatings must have low thermal conductivity, strongly adhere to the article, and remain adherent throughout many heating and cooling cycles. The latter requirement is particularly demanding due to the different coefficients of thermal expansion between materials having low thermal conductivity and superalloy materials typically used to form turbine engine components. Thermal barrier coating systems capable of satisfying the above requirements have generally included a metallic bond coat deposited on the component surface, followed by an adherent ceramic layer that serves to thermally insulate the component. In order to promote the adhesion of the ceramic layer to the component and prevent oxidation of the underlying superalloy, the bond coat is typically formed from an oxidation-resistant aluminum-containing alloy such as MCrAlY where M is iron, cobalt and/or nickel, or from an oxidation-resistant aluminum-based intermetallic such as a diffusion aluminide or platinum aluminide. Various ceramic materials have been employed as the ceramic layer, particularly zirconia ($ZrO_2$) stabilized by yttria ($Y_2O_3$), magnesia (MgO) or another oxide. These particular materials are widely employed in the art because they exhibit desirable thermal cycle fatigue properties, and also because they can be readily deposited by plasma spray, flame spray and vapor deposition techniques.

A significant challenge of thermal barrier coating systems has been to increase the resistance of the ceramic layer to spallation when subjected to thermal cycling. For this purpose, the prior art has proposed various coating systems, with considerable emphasis on ceramic layers having enhanced strain tolerance as a result of the presence of porosity, microcracks and segmentation of the ceramic layer. Microcracks generally denote random internal discontinuities within the ceramic layer, while segmentation indicates the presence of microcracks or crystalline boundaries that extend perpendicularly through the thickness of the ceramic layer, thereby imparting a columnar grain structure to the ceramic layer. Thermal barrier coating systems employed in high temperature applications of a gas turbine engine are typically deposited by physical vapor deposition (PVD) techniques that yield the desirable columnar grain structure, which is able to expand without causing damaging stresses that lead to spallation.

The bond coat is also critical to promoting the spallation resistance of a thermal barrier coating system. As noted above, the bond coat provides an oxidation barrier for the underlying superalloy substrate, such that spallation is less likely to occur due to oxidation of the substrate surface. Bond coat materials that contain aluminum, such as the intermetallic aluminides and MCrAlY alloys noted above, can undergo forced or natural oxidation to grow a strong adherent continuous aluminum oxide (alumina) surface layer that further protects the bond coat from oxidation and hot corrosion and provides a firm foundation for the ceramic layer. Though bond coat materials are particularly alloyed to be oxidation-resistant, oxidation inherently occurs due to the presence of aluminum in the bond coat, and the resulting oxide layer continuously grows over time at elevated temperatures, such that spallation eventually occurs at the interface between the bond coat and the ceramic layer.

The above-noted mechanism for spallation is illustrated in FIG. 1, which illustrates a thermal barrier coating system 10 composed of an aluminum-based bond coat 12 and an insulating ceramic layer 16. Also shown is a "Natural" alumina layer 14 between the bond coat 12 and ceramic layer 16. The alumina layer 14 is defined herein as "natural" to denote its growth as being the result of oxidation that occurs naturally and immediately upon exposure of the aluminum-containing bond coat 12 to oxygen or other oxidizing agents. Though not required, the alumina layer 14 can be intentionally grown by appropriately exposing the bond coat 12 to an oxidizing atmosphere at an elevated temperature. The lefthand illustration of FIG. 1 is intended to depict the thermal barrier coating system 10 as it appears immediately after formation. The second illustration shows the growth of the alumina layer 14 as a result of exposure of the coating system 10 to elevated temperatures. The right-hand illustration of FIG. 1 depicts the alumina layer 14 as having grown to a critical thickness at which spallation occurs at the interface between the bond and alumina layers 12 and 14.

From the above, it is apparent that oxidation of the bond coat, resulting in the growth of an oxide layer between the bond coat and the ceramic layer, is a contributing factor to spallation of a thermal barrier coating system. Accordingly, it would be desirable if the growth rate of the oxide layer could be reduced so as to increase the life of the coating system.

SUMMARY OF THE INVENTION

It is an object of this invention to provide a method for forming a thermal barrier coating system on an article designed for use in a hostile thermal environment, in which the coating system includes a ceramic layer overlying an aluminum-containing bond coat on the surface of the article.

It is another object of this invention that such a method entails a processing step that reduces the rate of growth of an oxide layer from the bond coat.

It is yet another object of this invention that the processing step entails the formation of a diffusion barrier layer over the bond coat.

It is a further object of this invention that the diffusion barrier layer is an oxide layer that is formed in a manner that inhibits infiltration of oxidizing agents to the bond coat.

The present invention generally provides a method of forming a thermal barrier coating on an article designed for use in a hostile thermal environment, such as turbine, combustor and augmentor components of a gas turbine engine. This method is particularly directed to increasing the spallation resistance of a thermal barrier coating system composed of an aluminum-containing bond coat formed on the surface of an article, and an insulating ceramic layer overlaying the bond coat. The processing steps of the invention generally include forming the bond coat on the surface of the article, and then treating the surface of the bond coat with laser energy so as to form a diffusion barrier layer of alumina. According to this invention, the bond coat may be permitted to undergo oxidation prior to the treating step so as to form a "natural" alumina layer on which the diffusion barrier layer is formed, or may deliberately undergo forced oxidation prior to the treating step so as to form an alumina layer of controlled thickness. Thereafter, a ceramic material is deposited on the surface of the diffusion barrier layer so as to form the insulating ceramic layer.

A preferred technique for the treating step is to scan the surface of the bond coat with an ultraviolet laser beam characterized by an appropriate beam geometry and fluence to yield the desired diffusion barrier layer. According to this invention, the diffusion barrier layer significantly reduces the rate at which the bond coat oxidizes, such that the life of the thermal barrier coating system is significantly increased as a result of slower growth of the alumina layer between the bond coat and the ceramic layer.

Other objects and advantages of this invention will be better appreciated from the following detailed description.

BRIEF DESCRIPTION OF THE DRAWINGS

The present invention will now be described by way of example, with reference to the accompanying drawings in which.

DETAILED DESCRIPTION OF THE INVENTION

The present invention is generally applicable to components that operate within environments characterized by relatively high temperatures, and are therefore subjected to severe thermal stresses and thermal cycling. Notable examples of such components include the high and low pressure turbine nozzles and blades, shrouds, combustor liners and augmentor hardware of gas turbine engines. While the advantages of this invention are particularly applicable to components of gas turbine engines, the teachings of this invention are generally applicable to any component with which a thermal barrier may be used to thermally insulate the component from its environment.

Figure 2:
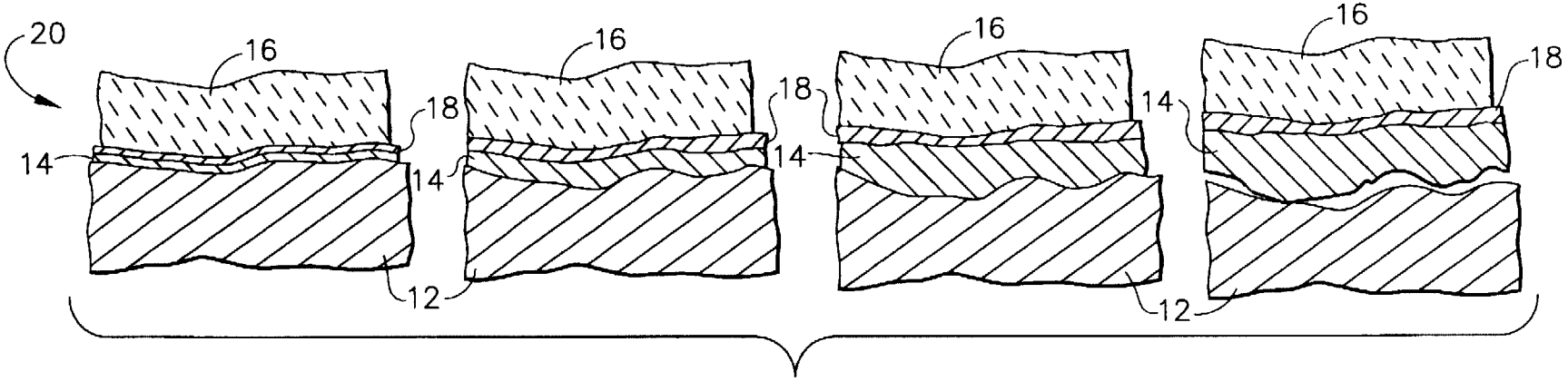
FIG. 2 illustrates the reduced rate of oxide growth for a thermal barrier coating system processed in accordance with this invention.

As represented in FIG. 2, the method of this invention is particularly adapted for a thermal barrier coating system 20 composed of an oxidation-resistant aluminum-containing bond coat 12 formed on the surface of a substrate (not shown), such as a superalloy article, and a ceramic layer 16 overlaying the bond coat 12. According to the invention, the bond coat 12 may be formed by an aluminum-containing nickel-base alloy powder, such as NiCrAlY, or an aluminum-based intermetallic, such as nickel or platinum aluminide. A bond coat 12 of either type is preferably deposited to a thickness of about 20 to about 250 micrometers. Preferred methods for depositing the bond coat 12 include vapor deposition techniques for aluminide coatings and low pressure plasma spray (LPPS) techniques for NiCrAlY coatings, though it is foreseeable that other deposition methods such as air plasma spray (APS) or physical vapor deposition (PVD) techniques could be used.

Following deposition of the bond coat 12, the surface of the bond coat 12 is preferably cleaned, such as by grit blasting, to remove contaminants and surface irregularities. An oxide layer 14 may then be intentionally grown on the surface of the bond coat 12 by forced oxidation at an elevated temperature, or otherwise permitted to grow as a result of natural oxidation of the aluminum in the bond coat 12, producing what is termed herein a "natural" oxide layer 14. The oxide layer 14 provides a surface to which the ceramic layer 16 can tenaciously adhere, thereby promoting the resistance of the coating system 20 to thermal shock. According to this invention, the oxide layer 14 is preferably not thicker than about one micrometer.

To attain a strain-tolerant columnar grain structure, the ceramic layer 16 is preferably deposited by physical vapor deposition using techniques known in the art. A preferred material for the ceramic layer 16 is an yttria-stabilized zirconia (YSZ), a preferred composition being about 6 to about 8 weight percent yttria, though other ceramic materials could be used, such as yttria, nonstabilized zirconia, or zirconia stabilized by ceria ($CeO_2$) or scandia ($Sc_2O_3$). The ceramic layer 16 is deposited to a thickness that is sufficient to provide the required thermal protection for the underlying substrate, generally on the order of about 25 to about 500 micrometers.

As a component of a gas turbine engine, the coating system 20 and its underlying substrate are subjected to hot combustion gases during operation of the engine, and are therefore subjected to severe attack by oxidation. As represented in FIG. 2, oxidation of the bond coat 12 ultimately leads to spallation of the coating system 20 at the interface between the bond coat 12 and the oxide layer 14, the latter of which continues to grow from the bond coat 12 over time. According to this invention, the growth rate of the oxide layer 14 is reduced by forming a diffusion barrier coating 18 on the oxide layer 14, as shown in FIG. 2. When appropriately formed in accordance with this invention, the diffusion barrier coating 18 is able to inhibit diffusion of oxygen and other oxidizing agents through the oxide layer 14 to the bond coat 12, and therefore reduces the rate at which the bond coat 12 oxidizes and the oxide layer 14 grows. According to this invention, the diffusion resistance of the diffusion barrier layer 18 is superior to that of the oxide layer 14 as a result of the manner in which the diffusion barrier layer 18 is formed.

Figure 3:
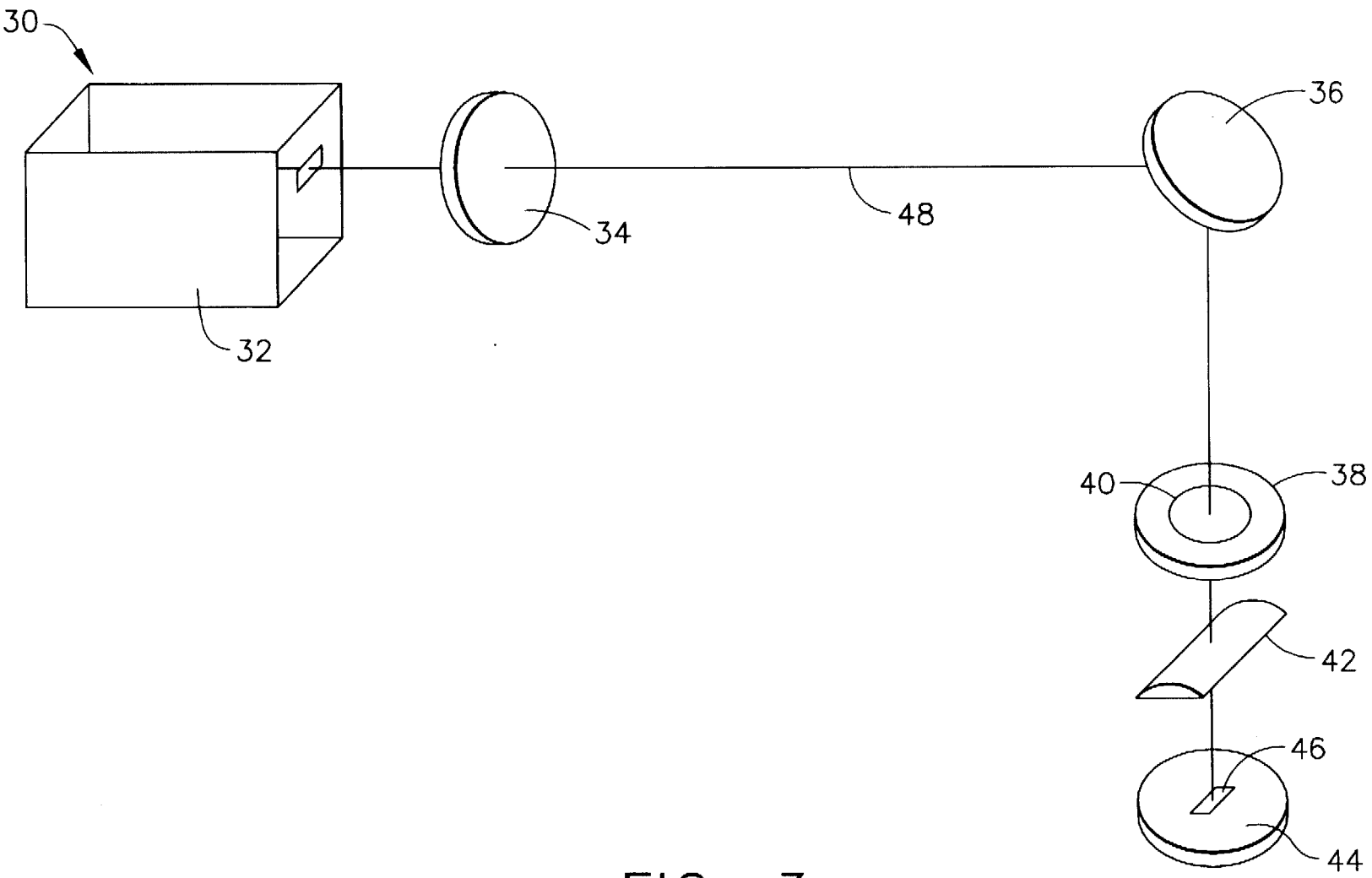
FIG. 3 schematically represents a laser system adapted for use in the processing of a thermal barrier coating system in accordance with this invention.

According to this invention, a preferred process for forming the diffusion barrier layer 18 is to subject the surface of the bond coat 12 (inclusive of the oxide layer 14) to a high energy laser beam 48 (e.g., ultraviolet) whose energy, beam geometry and interaction time are appropriately adjusted. A preferred laser system 30 is depicted schematically in FIG. 3 to include an excimer laser 32, a field lens 34, a 90° turning mirror 36, a mechanical aperture 38 and a cylindrical lens 42. The laser 32, field lens 34 and turning mirror 36 are of the type known in the laser art, and therefore need not be discussed in any detail. The mechanical aperture 38 preferably has an opening 40 sized to clean the laser beam 48 and to use the center part of the cylindrical lens 42 and to reduce optical aberrations. Finally, the cylindrical lens 42 serves to shape and orient the focused beam on a target 44 along any selected axis. The result is a clean rectangular-shaped beam cross-section 46 that is focused on the target 44, such as the bond coat 12 of FIG. 2, by adjusting the distance between the lens 42 and the target 44. The beam fluence on the target 44 is adjusted by varying the distance between the lens 42 and the target 44. The interaction time is varied by adjusting the transverse speed of the target 44. The transverse speed is preferably in the range of about 10 to 100 centimeters per minute to generate the desired diffusion barrier layer 18, which is alumina as a result of heating and oxidation of the bond coat 12. A suitable thickness for the diffusion barrier layer 18 is about 0.1 to about 2 micrometers, though it is foreseeable that thicker or thinner barrier layers 18 could be employed.

Figure 1:
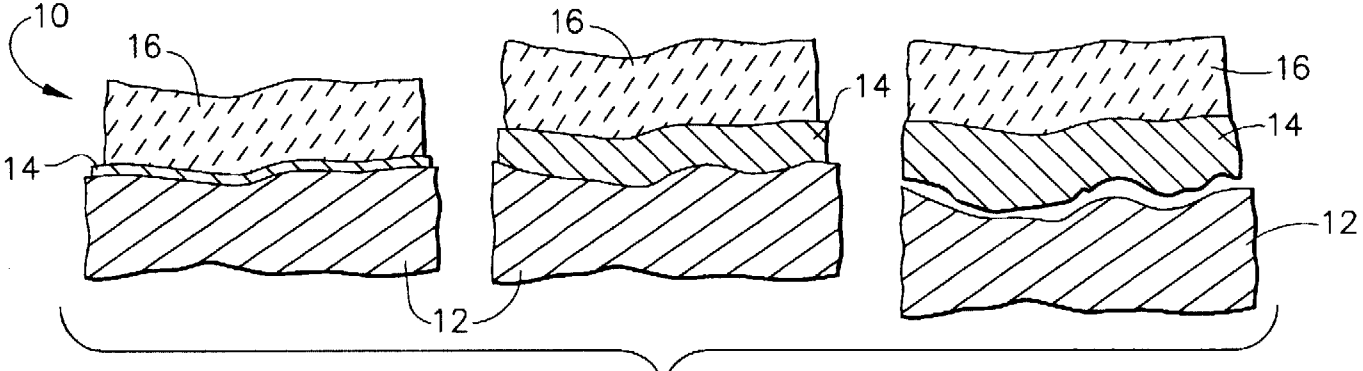
FIG. 1 (PRIOR ART)
FIG. 1 illustrates the gradual occurrence of oxide growth and eventual spallation of a thermal barrier coating system of the prior art.

Thermal barrier coating systems produced in the manner described above have exhibited unexpectedly good thermal cycle resistance, as evidenced by an enhanced resistance to spallation when cycled to elevated temperatures. Comparative evaluations performed on thermal barrier coating systems formed in accordance with the prior art (FIG. 1) and this invention (FIG. 2) have indicated that an improvement of 30% or more can be achieved with the process of this invention, as quantified by a longer life when subjected to thermal cycling. In all cases, spallation generally occurred when the oxide layer 14 reached a critical thickness of about four to five micrometers. However, the thermal barrier coating systems 20 processed in accordance with this invention exhibited slower growth of the oxide layer 14, thereby significantly delaying the occurrence of spallation at the interface between the bond coat and the oxide layer, as indicated by a direct comparison between the illustrations of FIGS. 1 and 2.

While our invention has been described in terms of a preferred embodiment, it is apparent that other forms could be adopted by one skilled in the art. Accordingly, the scope of our invention is to be limited only by the following claims.

What is claimed is:

1. A method for forming a thermal barrier coating system on an article, the method comprising the steps of:

forming an aluminum-containing bond coat on a substrate;

forming an oxide layer on a surface of the bond coat;

treating the surface of the bond coat with laser energy so as to form a diffusion barrier layer of alumina on the oxide layer; and depositing a ceramic material on the diffusion barrier layer.

2. A method as recited in claim 1 wherein the depositing step is a physical vapor deposition technique.

3. A method as recited in claim 1 further comprising the step of grit blasting the surface of the bond coat prior to forming the oxide layer.

4. A method as recited in claim 1 wherein the treating step entails scanning the oxide layer and the bond coat with an ultraviolet beam.

5. A method as recited in claim 4 wherein the ultraviolet laser beam is directed at the oxide layer through an aperture and then a cylindrical lens so as to generate a clean focused rectangular beam on the surface.

6. A method as recited in claim 4 wherein the treating step entails scanning the oxide later with the ultraviolet laser beam at a rate of about 10 and 100 centimeters per minute.

7. A method as recited in claim 1 wherein the treating step results in the diffusion barrier layer having a thickness of about 0.1 to about 2 micrometers.

8. A method as recited in claim 1 wherein the bond coat is an aluminide intermetallic.

9. A method for forming a thermal barrier coating system on an article, the method comprising the steps of:

forming an aluminum-containing oxidation-resistant bond coat on a substrate;

allowing a natural alumina layer to grow on a surface of the bond coat;

treating the surface of the bond coat with laser energy so as to form a diffusion barrier layer of alumina on the natural alumina layer surface; and depositing a ceramic material on the diffusion barrier layer so as to form a thermal barrier coating that completely covers and adheres to the diffusion barrier layer.

10. A method as recited in claim 9 wherein the depositing step is a physical vapor deposition technique and the thermal barrier coating has a columnar grain structure.

11. A method as recited in claim 9 further comprising the step of grit blasting the surface of the bond coat prior to the step of growing the natural alumina layer.

12. A method as recited in claim 9 wherein the treating step entails scanning the surface of the bond coat with an ultraviolet laser beam.

13. A method as recited in claim 12 wherein the ultraviolet laser beam is directed at the surface of the bond coat through an aperture and then a cylindrical lens so as to generate a clean focused rectangular beam on the target.

14. A method as recited in claim 12 wherein the treating step entails scanning the surface of the bond coat with the ultraviolet laser beam at a rate of about 10 to about 100 centimeters per minute.

15. A method as recited in claim 9 wherein the treating step results in the diffusion barrier layer having a thickness of about 0.1 to about 2 micrometers.

16. A method as recited in claim 9 wherein the bond coat is an aluminide intermetallic.

17. A method for forming a thermal barrier coating system on an article, the method comprising the steps of:

forming an aluminum-based oxidation-resistant bond coat on a superalloy substrate;

growing a natural alumina layer on a surface of the bond coat, the natural alumina layer having a thickness of not more than one micrometer;

scanning the surface of the bond coat with an ultraviolet laser beam so as to form a diffusion barrier layer of alumina on the natural alumina layer surface, the diffusion barrier layer having a thickness of about 0.1 to about 2 micrometers; and depositing a ceramic material on the diffusion barrier layer by physical vapor deposition so as to form a thermal barrier coating that covers and adheres to the diffusion barrier layer.

* * * * *